US007549515B2

(12) United States Patent
Tegtmeier et al.

(10) Patent No.: US 7,549,515 B2
(45) Date of Patent: Jun. 23, 2009

(54) ELECTRICAL ELEVATOR RESCUE SYSTEM

(75) Inventors: Dirk Heinrich Tegtmeier, Berlin (DE); Kristian Bernhard Wittjen, Berlin (DE)

(73) Assignee: Otis Elevator Company, Farmington, CT (US)

( * ) Notice: Subject to any disclaimer, the term of this patent is extended or adjusted under 35 U.S.C. 154(b) by 260 days.

(21) Appl. No.: 10/575,024

(22) PCT Filed: Oct. 7, 2003

(86) PCT No.: PCT/EP03/11093

§ 371 (c)(1),
(2), (4) Date: May 22, 2007

(87) PCT Pub. No.: WO2005/040027

PCT Pub. Date: May 6, 2005

(65) Prior Publication Data

US 2007/0272492 A1 Nov. 29, 2007

(51) Int. Cl.
*B66B 1/32* (2006.01)

(52) U.S. Cl. ..... 187/288; 187/290; 187/291

(58) Field of Classification Search ..... 187/247, 187/248, 313, 284, 288–291, 292, 296, 297, 187/391–393; 307/66, 68, 69
See application file for complete search history.

(56) References Cited

U.S. PATENT DOCUMENTS 4,316,097 A 2/1982 Reynolds
4,376,471 A 3/1983 Uchino et al.
5,058,710 A 10/1991 Iwasa
5,969,303 A * 10/1999 Piserchia et al. ..... 187/297
6,196,355 B1 3/2001 Fargo et al.
6,264,005 B1 * 7/2001 Kang et al. ..... 187/290
6,732,838 B1 * 5/2004 Okada et al. ..... 187/290
2008/0202859 A1 * 8/2008 Tegtmeier et al. ..... 187/290

OTHER PUBLICATIONS

PCT International Search Report for PCT/EP2003/011093, dated Jun. 24, 2004.
PCT International Preliminary Examination Report for PCT/EP2003/011093, dated Jan. 30, 2006.
PCT Written Opinion for PCT/EP2003/011093, dated Jan. 11, 2006.
Korean Intellectual Propoerty Office Notice of Invitation to Submit Opinion Concerning Korean Counterpart Application No. 10-2006-7006694.

* cited by examiner

*Primary Examiner*—Jonathan Salata

(57) ABSTRACT

Elevator (2) comprising a car (4), a counterweight (6), a hoisting rope (8) for suspending the car (4) and the counterweight (6), a drive motor (10), a motor drive unit (26) for supplying the power to the drive motor (10), and a brake (18) for stopping the movement of the car (4) in an emergency situation, the elevator (2) further comprising an elevator rescue system (40), comprising an emergency power supply (42), an emergency brake switch (44) for connecting and disconnecting the power of the emergency power supply (42) to the brake (18), and an emergency drive switch (46) for connecting and disconnecting the power of the emergency power supply (42) to the drive motor (10), characterised in that the elevator rescue system (40) further comprises the motor drive unit (26) and a power line (74) connecting the emergency power supply (42) with the motor drive unit (26) and including the emergency drive switch (46).

12 Claims, 1 Drawing Sheet

ELECTRICAL ELEVATOR RESCUE SYSTEM

Figure 1:
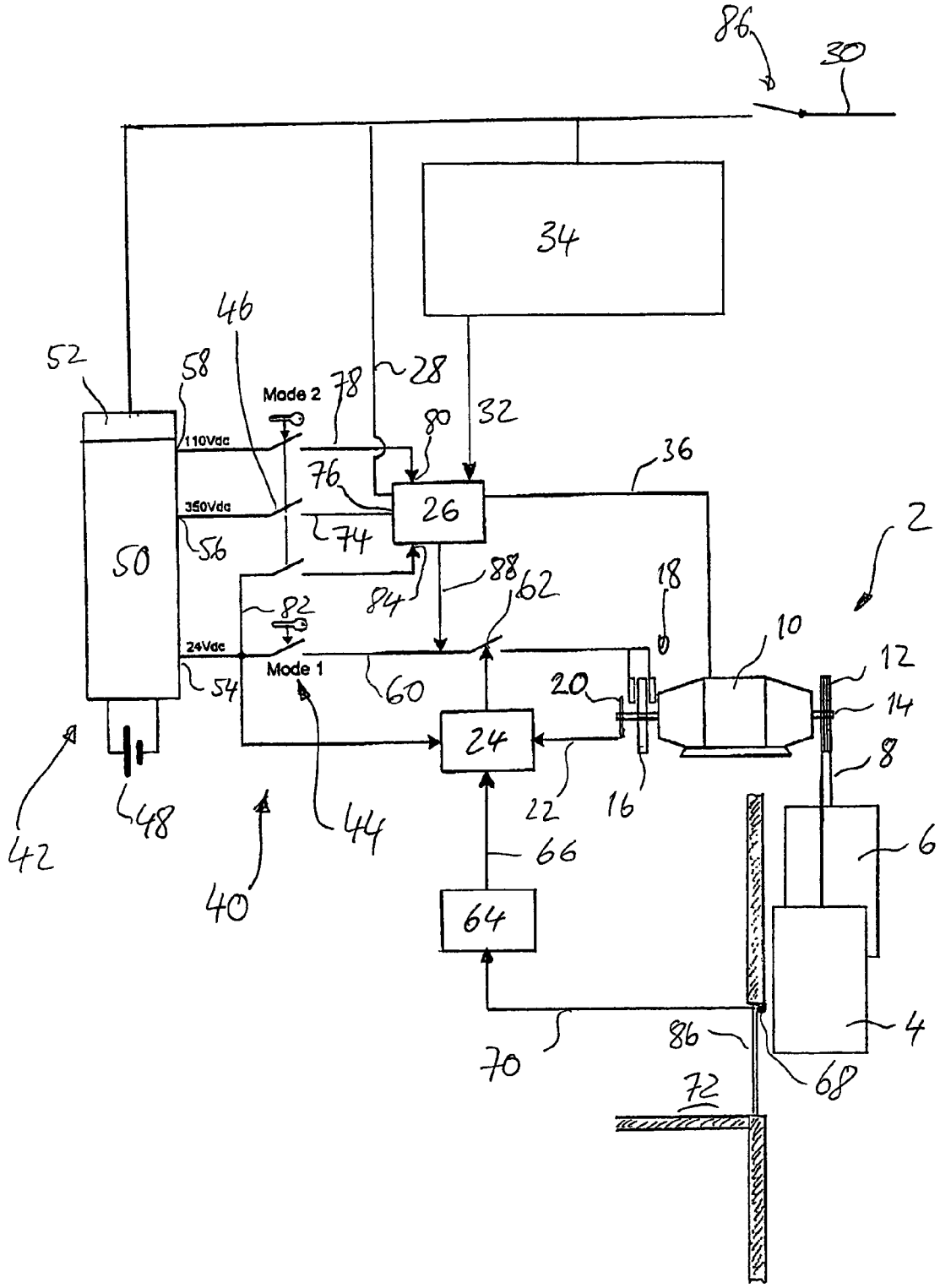

The present invention relates to an elevator comprising a car, a counterweight, a hoisting rope for suspending the car and the counterweight, a drive motor, a motor drive unit for supplying the power to the drive motor, and a brake for stopping the movement of the car in an emergency situation, the elevator further comprising an elevator rescue system comprising an emergency power supply, an emergency brake switch for connecting and disconnecting the power of the emergency power supply to the brake, and an emergency drive switch for connecting and disconnecting the power of the emergency power supply to the drive motor.

Such an elevator is known from U.S. Pat. No. 5,821,476. Particularly, this document teaches a carry-along emergency device including an emergency DC power supply, a switching device for alternately feeding DC voltage to windings of the motor and an actuator for releasing the elevator brake. The switching device typically is a rotary switch having six contacts which are connected to the winding of the drive motor so that in the course of rotating the switch from one contact to the next contact the windings of the elevator motor are successively energized, thus advancing the car and the counterweight step by step.

Other prior art like U.S. Pat. No. 4,376,471 teach battery-operated inverters for converting the battery DC power into an AC power for supplying it to the drive motor. However, inverters are expensive.

The most common emergency situation is due to a power failure in the main power supply to the elevator. In such a situation the power to the drive motor is interrupted and the brake falls in and stops the movement of the elevator car independent from the position thereof in the elevator shaft. Accordingly, the passengers are trapped in the elevator car. Other emergency situations can be due to defects in the elevator itself, for example in the safety chain, the elevator control, etc. In such an emergency situation it is mandatory to free the passengers from the elevator car as soon as possible.

There are two different emergency situations, i.e. one emergency situation in which car and counterweight are in an unbalanced situation, i.e. once the brake is lifted, the car starts moving by gravity. U.S. Pat. No. 6,196,355 B1 discloses an electrical elevator rescue system for freeing the passengers in this situation. However, there also is the balanced load situation, i.e. even after lifting the brake, the car remains at its position. Due to the fact that elevators are typically designed so as to be in a balanced situation for the most common operational conditions, such a balanced load situation is not uncommon.

While the above-referenced U.S. Pat. No. 5,821,476 allows to move the elevator car even in a balanced load situation, this document teaches a relatively complicated rescue device.

It is the object of the present invention to provide an elevator with an elevator rescue system as defined above, which rescue system is reliable, cost-efficient and easy to control.

According to the present invention, this object is achieved by an elevator as defined above and wherein the elevator rescue system further comprises the motor drive unit and a power line connecting the emergency power supply with the motor drive unit and including the emergency drive switch.

Thus the present invention uses the motor drive unit which is already present in the elevator for supplying the emergency power to the drive motor. The motor drive unit typically has an input for the AC main power supply, a rectifier, a DC intermediate circuit and a converter. The emergency power supply line can either be connected to the AC input or the DC intermediate circuit, depending on the particular motor drive unit.

The converter may either be of the VF inverter type (variable frequency inverter) or of the VVVF inverter type (variable voltage variable frequency inverter). By using the conventional motor drive unit of the elevator the number of additional parts of the elevator rescue system can be reduced.

The switches can either be conventional switches or can also comprise any other type of switching means, i.e. may form part of a microprocessor control. Particularly, the emergency drive switch means can be integral with the motor drive unit. It can be designed so as to automatically switch to the emergency power supply in all or specific failure situations.

Preferably, the emergency power supply provides at least two different output voltages, wherein the brake is connected via the emergency brake switch to the lower voltage output and wherein the higher voltage output is connected to the motor drive unit.

Preferably, the emergency power supply comprises a storage battery and a voltage booster for increasing the output voltage of the battery. The emergency power supply can further include a battery loading circuit and a supervisor which is connected to the main power supply. The voltage booster can be a conventional converter for converting the battery voltage to a higher voltage to be supplied to the motor drive unit. In normal operation a conventional motor drive unit receives an AC voltage in the order of 380 V. However, the voltage required for driving the elevator car in a balanced load situation is by far less than the required voltage for normal operation. Accordingly, particularly with a VVVF inverter type the drive motor substantially requires lower voltages for emergency operation. On the other hand, the motor drive unit circuit requires a certain input voltage independent from the particularly output voltage. Therefore the higher output voltage of the emergency power supply should be at least approximately 250 V, preferably 300 V, more preferred 320 V, and most preferred at least approximately 350 V. Accordingly, the higher voltage may be different depending on the normal voltage required by the drive motor and the motor drive unit circuit, respectively. The lower voltage needs to be sufficient for lifting the brake. However, as the brake is preferably connected with the speed control even in the emergency mode, the lower voltage should preferably be high enough to be used as the input voltage for the speed control circuit. A typical voltage is approximately 24 V. The DC battery of the emergency power supply can have a nominal voltage of 12 V or 24 V. However, even in case of a 24 V battery, it is preferred to use a booster circuit also for emitting the lower voltage from the emergency power supply in order to guarantee a constant voltage output.

Preferably, the emergency brake and the motor drive unit are coupled with each other in a way which allows energizing of the drive motor only if the brake is energized. Such a coupling guarantees that the brake is lifted in advance of supplying power to the drive motor. This can be done for example by coupling the respective switches either mechanically or electrically. A particularly simple construction is the positioning of the emergency brake switch with respect to the emergency drive switch so that it is impossible to switch the emergency drive switch before the emergency brake switch has been switched. The person skilled in the art will be able to implement such a solution. Coupling of the switches is an easy mechanical solution. However any other implementation which assures lifting of the brake in advance of supplying power to the drive motor can be used.

Preferably, the brake and the motor drive unit are coupled with each other in a way which allows energizing of the brake only if the motor drive unit is energized. Preferably, the coupling is such that the brake is energized only if the motor drive unit is in an operational mode. Energizing of the motor drive unit in advance of the brake guaranties that the motor drive unit can control the movement of the car once the brake is lifted. There exist motor drive units which can monitor the movement of the car very closely. Thus, such a motor drive unit can monitor as to whether the car starts moving after the brake has been lifted or whether the car is in a balance load situation. Such a motor drive unit can also control the speed of the moving car and activate the brake in order to avoid any overspeed situation. Moreover, the motor drive unit may also include a data storage medium which includes data of the elevator system of just before the failure occurred, i.e. data like current and voltages supplied to the motor which are related with the load situation of the car, the position of the car on its path, like the distance to the next landings, etc. For example this memory can be an EEPROM or the like. The motor drive unit can use such data for making a decision on how to operate the car in the emergency situation, i.e. moving the car by gravity, powering the drive motor for moving the car, in which direction to move the car, etc. Again this coupling can be achieved by a mechanical or electrical coupling.

It is also possible to energize brake and motor drive unit at the same or about the same time.

Preferably, the elevator further comprises a main power switch for disconnecting the main power supply to the elevator, wherein the emergency brake and/or the emergency drive switches are coupled with the main power switch in a way which allows energizing of the brake and/or the drive motor, respectively, only if the main power supply is disconnected. Again, the coupling of the switches can be realized as mentioned before. It is preferred to disconnect the main power supply before starting a rescue operation for safety reasons. Thus the emergency operation can be stopped in a controlled way, before the main power is connected to the elevator again. Without such a feature an unsecured or undefined condition can occur if during a rescue operation the main power will terminate, and the main power will be supplied to the elevator even though the emergency power supply supplies power to some of the elevator components.

Preferably, the elevator further comprises a safety chain which is connected with a safety chain input of the motor drive unit wherein the emergency power supply comprises a safety chain voltage output which provides a safety chain voltage to the safety chain input of the motor drive unit via the emergency drive switch. The safety chain typically comprises a plurality of safety contacts like door contacts, etc., which are arranged in series with each other. The safety chain insures that the elevator drive motor is operated only if all safety contacts are closed, i.e. if the elevator is in a safe condition. In case of a power failure the power supply for the safety chain is also interrupted. Accordingly, no voltage is applied to the safety chain input of the motor drive unit. In order to allow the motor drive unit to drive the drive motor in a rescue mode it is necessary to provide the safety chain input of the motor drive unit with a "faked" safety chain voltage. Such voltage can be provided by the emergency power supply as well. The safety chain voltage typically is between the higher and the lower voltages, for example 48 V DC and 110 V AC, respectively. Alternatively the emergency power supply may supply its power to the input of the safety chain. In this case all the safety chain contacts need to be closed in order to allow movement of the elevator car even in a rescue mode.

Preferably the motor drive unit further comprises a control input which is connected via the emergency drive switch to a voltage output of the emergency power supply wherein the motor drive unit is designed to provide to the drive motor with a power supply according to an emergency rescue mode, if a predetermined voltage output is applied to its control input. In normal operation the motor drive unit receives control signals through its control input from the elevator control. Since in the rescue mode, however, the elevator control typically is out of service, an emergency rescue mode signal needs to be generated and supplied to the control input of the motor drive unit. Preferably the predetermined voltage corresponds to the lower voltage output of the emergency power supply. This construction makes a separate emergency elevator control superfluous.

Preferably the elevator further comprises a door zone indicating device wherein that door zone indicating device is connected to the elevator rescue system for stopping the car at a landing once the door zone indicating device has signaled that the car is positioned at a landing. The door zone indicating device is a common component in the elevator and is necessary for proper operation of the elevator. Typically the door zone indicating device signals approaching a landing and leveling at a landing. In order to insure correct positioning of the elevator car at a landing even in case of a rescue operation, the door zone indicating device is used in the elevator rescue system. Preferably the door zone indicating device stops the car at the next landing where the elevator door can be opened manually by the person operating the rescue system or automatically by the elevator rescue system.

Preferably the elevator further comprises a speed control unit for controlling the speed of the car, wherein the speed control unit is connected to the elevator rescue system and particularly to the brake.

The invention and an embodiment of the invention are described below in greater detail with reference to the FIGURES, wherein the only FIG. 1 shows an elevator in accordance with the present invention.

FIG. 1 shows an elevator 2 comprising a car 4 and a counterweight 6. The car 4 and the counterweight 6 are suspended by a hoisting rope 8. The hoisting rope 8 is driven by a drive motor 10 via a traction sheave 12. Attached to the shaft 14 of the drive motor 10 is a brake disc 16 of a brake 18. Also attached to shaft 14 is an encoder wheel 20 providing speed control information via line 22 to a speed control 24.

A motor drive unit 26 is connected with the main power supply 30 of the elevator 2 through line 28 and receives control signals from an elevator control 34 through line 32. In accordance with the control signals of the elevator control 34 the motor drive unit 26 supplies the required power to the drive motor 10 through line 36. Particularly the motor drive unit 26 comprises a rectifier for rectifying the AC current received through line 28, an intermediate DC circuit and an VVVF inverter (Variable Voltage Variable Frequency). The VVVF inverter varies the voltage and frequency output through line 36 to the drive motor 12 in accordance with the control signals of the elevator control 34.

The elevator 2 further comprises an elevator rescue system 40 which is formed of conventional components of the elevator system, i.e. the motor drive unit 26 and the speed control 24, on the one hand, and of additional components which are specific to the elevator rescue system 40. Such additional components comprise the emergency power supply 42, the emergency brake switch 44 and the emergency drive switch 46.

The emergency power supply 42 includes a storage battery 48, a voltage booster 50 and a battery loading and supervising circuit 52. The emergency power supply provides three different output voltages, i.e. a lower voltage to voltage output 54, a higher voltage to output 56, and an intermediate voltage to output 58. Depending on the particular elevator, the voltage values may vary. However, typical voltage values are 24 V DC for lifting the brake and for supplying the electric control devices like speed control, etc., 110 V as this is the typical voltage used for the elevator safety chain, and 350 V DC for supplying the motor drive unit 26 and eventually the drive motor 10. The latter voltage depends on the particular construction of the motor drive unit 26. Typically such a motor drive unit 26 requires a minimum input voltage even though the output voltage to the drive motor 10 will typically be far less in a balanced load emergency operation mode.

The lower voltage is supplied through line 60 and the emergency brake switch 44 through the solenoid (not shown) of the brake 18. A speed control switch 62 is provided in line 60. The speed control switch 62 is controlled by the speed control 24. The latter receives its information about the speed of the elevator car via line 22 from the encoder wheel 20. The speed control 24 further receives information from a door zone indicator (DZI) 64 via line 66. The door zone indicator 64 is connected with a door zone sensor 68 via line 70. The door zone sensor 68 signals to the speed control 24, once the elevator car approaches and reaches a landing 72. Accordingly, the speed control can interrupt the power supply to the brake 18 in case of overspeed of the elevator car 4 or if the elevator car 4 has reached a landing 72.

The higher voltage is supplied from output 56 through line 74 to the power input 76 of motor drive unit 26. Emergency drive switch 46 is located in line 74. The intermediate voltage is supplied through line 78 from output 58 to safety chain input 80 of the motor drive unit 26. Moreover, the lower voltage from output 54 is connected via line 82 through the control signal input 84 of the motor drive unit 26.

The emergency drive switch 46 actually comprises three switches in lines 82, 74 and 78. Accordingly, the emergency drive switch 46 jointly switches the low, the intermediate and the higher voltages to the motor drive unit 26. However, there is no need to jointly switch the voltages to the motor drive unit 26. Accordingly, it is possible to have three individual switches instead of the common emergency drive switch 46.

The elevator 2 further comprises a main power switch 86 which is located in the main power supply line 30. It is preferred to disconnect the main power supply from the elevator 2 before initiating an emergency drive mode of operation in order to assure well defined operating conditions even if during emergency mode the main power supply may be reestablished. Preferably the main power switch 86 is connected—mechanically or electronically—with the emergency drive switch 46 and/or the emergency brake switch 44. In this context it is to be noted that only a fraction of the connections between the main power supply line 30, the elevator control 34 and the individual elevator component is shown in the drawing for clarity. For example, the drawing does not show the safety chain which typically is connected to the elevator control 34. The main focus of FIG. 1 is on the emergency rescue system and the elevator components embedded therein.

The switches 44, 46 and 86 are preferably located at a convenient position next to the elevator 2, for example integrated in a control panel (not shown). The switches can also be located remote from the elevator 2 proper, for example in a building control room, etc.

It is to be noted that the FIGURE is very schematic only and particularly shows a variety of separate controls, switches, etc. which all or some thereof could be integrated in the motor drive unit 26. Particularly, the speed control 24, the speed control switch 62 and/or the door zone indicator 64 could as well be part of the motor drive unit 26. It might also be possible to incorporate the emergency brake switch 44 into the motor drive unit 26. In this case a single manually operated switch like switch 46 can be sufficient to energize the motor drive unit and to start the emergency operation which is governed and controlled by the motor drive unit.

The operation of the elevator 2 in an emergency situation can be as follows:

Mode 1:

After an elevator failure has been detected, the technician or any other qualified person switches switch 44, thus supplying the lower voltage to brake 18 and lifting the brake. If the elevator 2 is in an unbalanced condition, the elevator car and counterweight 4 and 6, respectively, will start moving. The speed control 24 monitors the speed of the elevator car 4 and stops the car 4 if an overspeed condition occurs. Eventually, the sensor 68 will sense that the elevator car 4 is within a door zone, transmits a respective signal through line 70 to the door zone indicator 64 and interrupts the power supply via the speed control 24 and speed control switch 62 to the brake 18. Accordingly, the elevator car 4 will stop at landing 72. The qualified person can then manually open the elevator shaft door 86 and the elevator car door. If the car 4 is not moving within a fixed period of time, the emergency brake switch 44 can be closed. In this case the mode 1 rescue operation can be re-tried one or two (or even several) times. Eventually, if the elevator car 4 does not reach a landing 72 in the mode 1 rescue operation, the operator will initiate a mode 2 rescue operation.

Mode 2:

In the mode 2 rescue operation the operator switches the emergency drive switch 46, thus switching to the motor drive unit 26 the low, intermediate and higher voltages. The low voltage received through control input 84 signals to the motor drive unit 26 a rescue drive mode, i.e. low power, low speed, etc. Moreover, the low voltage is supplied through line 88 to brake 18 and lifts the brake. Accordingly, no mechanical coupling of the emergency brake switch 44 and the emergency drive switch 46 is required. The intermediate voltage "fakes" at the safety chain input 80 a positive safety chain signal, i.e. the motor drive unit 26 obtains a signal as if the safety chain (not shown) is properly working and signals that all safety chain contacts are closed. The motor drive unit 26 further receives the higher voltage through input 76 and, accordingly, supplies the drive voltage through line 36 to drive motor 10. Drive motor 10 will slowly move the elevator car 4 in either direction until the sensor 68 signals to the door zone indicator 64 that the elevator car 4 has reached a landing 72. If so, the speed control 24 will trigger brake 18 and stop the car 4 at the landing 72. The operator may then manually open the emergency drive switch 46. Alternatively, there is an automatic system for interrupting the power supply to motor 10 through line 36. The operator can again open the elevator door at landing 72 allowing the trapped persons to leave the elevator car 4.

Alternatively, the operation of the elevator 2 in an emergency situation can be as follows:

After an elevator failure has been detected, the technician or any other qualified person switches switch 46, thus supplying the lower, the intermediate and the higher voltage to the motor drive unit 26. The motor drive unit 26 determines on data stored in a storage whether the elevator system is in a balanced load situation or not. The motor drive unit then opens the brake 18 and, depending on the load situation, either allows the car 4 to move due to gravity while it monitors and controls the speed of the car through the speed control 24, or provides power to the motor 10 for moving the car to the next landing. Once the door zone indicator 64 signals that the car 4 is in a proper position for exit, the motor drive unit 26 stops the car by means of the brake 18. Again the operator can open the door at landing 72 and free the trapped persons from the elevator car 4.

The invention claimed is:

1. Elevator (2) comprising a car (4), a counterweight (6), a hoisting rope (8) for suspending the car (4) and the counterweight (6), a drive motor (10), a motor drive unit (26) for supplying the power to the drive motor (10), and a brake (18) for stopping the movement of the car (4) in an emergency situation, the elevator (2) further comprising an elevator rescue system (40), comprising an emergency power supply (42), an emergency brake switch (44) for connecting and disconnecting the emergency power supply (42) to the brake (18), and an emergency drive switch (46) for connecting and disconnecting the power of the emergency power supply (42) to the drive motor (10) and to the brake (18) wherein the elevator rescue system (40) further comprises the motor drive unit (26) and a power line (74) connecting the emergency power supply (42) with the motor drive unit (26) and including the emergency drive switch (46) and wherein the brake (18) and the motor drive unit (26) are coupled with each other in a way which allows energizing of the drive motor (10) only if the brake (18) is energized.

2. Elevator (2) according to claim 1, wherein the emergency power supply (42) provides at least two different output voltages, wherein the brake (18) is connected via the emergency brake switch (44) to the lower voltage output (54) and wherein the higher voltage output (56) is connected to the motor drive unit (26).

3. Elevator (2) according to claim 2, wherein the emergency power supply (42) comprises a storage battery (48) and a voltage booster (50) for increasing the output voltage of the battery (48).

4. Elevator (2) according to any of claims 1, further comprising a main power switch (86) for disconnecting main power supply to the elevator (2), wherein the emergency brake and/or the emergency drive switches (44; 46) are coupled with the main power switch (86) in a way which allows energizing of the brake (18) and/or the drive motor (10), respectively, only if the; main power supply is disconnected.

5. Elevator (2) according to any of claims 1, further comprising a safety chain which is connected with a safety chain input (80) of the motor drive unit (26), wherein the emergency power supply (42) comprises a safety chain voltage output (58) which provides a safety chain voltage to the safety chain input (80) of the motor drive unit (26) via the emergency drive switch (46).

6. Elevator (2) according to any of claims 1, wherein the motor drive unit (26) further includes a control input (84) which is connected via the emergency drive switch (46) to a voltage output (54) of the emergency power supply (42), wherein the motor drive unit (26) is designed to provide to the drive motor (16) a power supply according an emergency rescue mode if a pre-determined voltage is applied to its control input (84).

7. Elevator (2) according to any of claims 1, further comprising a door zone indicating device (64), wherein the door zone indicating device (64) is connected to the elevator rescue system (40) for stopping the car (4) at a landing (72) once the door zone indicating device (64) has signaled that the car (4) is positioned at a landing (72).

8. Elevator (2) according to any of claims 1, further comprising a speed control unit (24) for controlling the speed of the car (4), which is connected to the brake (18).

9. Method for performing an elevator rescue operation if a safety brake (18) of the elevator (2) has stopped the movement of an elevator car (4) due to an emergency situation, wherein the elevator (2) comprises the car (4), a counterweight (6), a hoisting rope (8) for suspending the car (4) and the counterweight (6), a drive motor (10), a motor drive unit (26) for supplying the power to the drive motor (10), and the brake (18) for stopping the movement of the car (4) in an emergency situation, the elevator (2) further comprising an elevator rescue system (49) having an emergency power supply (42), the method comprising the following steps:

(a) switching an emergency brake switch (44) thereby connecting the power of the emergency power supply (42) to the brake (18) and lifting the brake (18), (b) monitoring the speed of the car (4), (c) sensing whether the car (4) reaches a landing (72), and (d) switching the emergency brake switch (44) to disconnect the power to the brake (18), if the car (4) is not moving within a fixed period of time, and (e) if the car (4) does not reach a landing (42) during steps (a) to (d), switching an emergency drive switch (46) thereby connecting the power of the emergency power supply (42) to the motor drive unit (26), (f) supplying power from the motor drive unit (26) to the brake (18) and lifting the brake (18), (g) supplying power from the motor drive unit (26) to the motor (10) and moving the car (4), (h) sensing whether the car (4) has reached a landing (72), and (i) stopping the car (4) when it has reached a landing (72).

10. Method for performing an elevator rescue operation if a safety brake (18) of the elevator (2) has stopped the movement of an elevator car (4) due to an emergency situation, wherein the elevator (2) comprises the car (4), a counterweight (6), a hoisting rope (8) for suspending the car (4) and the counterweight (6), a drive motor (10), a motor drive unit (26) for supplying the power to the drive motor (10), and the brake (18) for stopping the movement of the car (4) in an emergency situation, the elevator (2) further comprising an elevator rescue system (49) having an emergency power supply (42), the method comprising the following steps:

(A) switching an emergency drive switch (46) thereby connecting the power of the emergency power supply (42) to the motor drive unit (26), (B) determining by means of the motor drive unit (26) based on stored data whether the car (4) and the counterweight (6) are in a balanced load situation or not.

(C) if car (4) and counterweight (6) are not in a balanced load situation, (C1) supplying power from the motor drive unit (26) to the brake (18), lifting the brake (18) and allowing the car (4) to move due to gravity, (C2) monitoring and controlling the speed of the car (4), or (D) if car (4) and counterweight (6) are in a balanced load situation, (D1) supplying power from the motor drive unit (26) to the motor (10) and moving the car (4), and (E) sensing whether the car (4) has reached a landing (72), and (F) stopping the car (4) when it has reached a landing (72).

11. Method according to claim 9, wherein the brake (18) and the motor drive unit (26) are coupled with each other in a way which allows energizing of the drive motor (10) only if the brake (18) is energized.

12. Method according to claim 9, further comprising the step of disconnecting the main power supply to the elevator (2) before switching the emergency brake switch (44) and/or the emergency power switch (46) to connecting power to the brake (18) and the motor drive unit (26), respectively.

* * * * *